United States Patent [19]

Arvidsson

[11] 4,031,790

[45] June 28, 1977

[54] LUMBER TRIMMER

[75] Inventor: Bengt Arvidsson, Sibbhult, Sweden

[73] Assignee: A & B Constructors AB, Markaryd, Sweden

[22] Filed: Mar. 18, 1976

[21] Appl. No.: 667,953

[30] Foreign Application Priority Data

Mar. 21, 1975 Sweden ..... 7503286

[52] U.S. Cl. ..... 83/425.4; 83/425.2; 144/312

[51] Int. Cl.[2] ..... B27B 5/02

[58] Field of Search ..... 83/425.2, 425.3, 425.4, 83/404; 144/312

[56] References Cited

UNITED STATES PATENTS

| | | | |
|---|---|---|---|
| 3,906,829 | 9/1975 | Westfall | 83/723 |
| 3,937,114 | 2/1976 | Joensson | 83/425.2 |

*Primary Examiner*—Donald R. Schran
*Attorney, Agent, or Firm*—Larson, Taylor and Hinds

[57] ABSTRACT

A lumber trimmer comprises a saw table for transversely moving lumber pieces to be trimmed, a stationary cross-cut saw for cutting one end of the lumber pieces and a plurality of trim saws for cutting the other end. All saws are disposed along a line extending lengthwise with the trim saws mounted at regular intervals on a saw carriage which is displaceable in the lengthwise direction. A linear pneumatic positioner for the saw carriage comprises three double-acting cylinders connected with each other in series relation. The ratios of the lengths of stroke of the cylinders are 1 to 2 to 3, so that the positioner is capable of positioning the saw carriage at any selected one of seven uniformly spaced-apart positions.

4 Claims, 3 Drawing Figures

LUMBER TRIMMER

This invention relates to a machine for cutting planks and boards and other elongated lumber pieces to pedetermined lengths. Machines of this kind are generally referred to as lumber trimmers and may be used in combination with a resawing or edging sawmill to trim the boards to standard lengths. The trimmer is operated such that defective end portion are cut off and each board is trimmed to the longest possible standard length.

Known lumber trimmers include a saw table on which the boards or other lumber pieces to be trimmed are transported in succession parallel to each other and oriented in a direction at right angles to their direction of movement on the saw table. The saw table is equipped with a plurality of crosscut saws adapted to cut the boards at both ends. These saws typically include a single base-end saw for cutting one end of the boards, such as the end resulting from the thicker end of the log, i.e. the base end, and a plurality of trim saws for cutting the other end of the boards at a selected one of a series of cutting positions uniformly spaced-apart in the longitudinal direction of the boards.

The trim saws are normally in an inoperative position out of the path of movement of the boards on the saw table, and as a board is advanced towards the saws, a selected one of the trim saws is manually or automatically actuated to move to an operative position to cut the approaching board. The base-end saw is always in an operative position in the path of movement of the boards, and while on the saw table, or before entering the saw table, each board is positioned lengthwise such that the end to be cut by the base-end saw is in an appropriate lengthwise position relative to the base-end saw.

It is of course desirable to reduce the losses of valuable lumber at the trim saws as much as possible. Therefore it is desirable that the distance between adjacent cutting positions of the trim saws be short. In conventional trimmers, however, a close spacing of the cutting positions necessitates a large number of trim saws.

The number of trim saws required for a given number of standard lengths may be reduced by providing one or a relatively small number of trim saws on a carriage which is displaceable transversely of the direction of movement of the boards and selectively positionable at any one of a number of predetermined positions. A trimmer embodying this principle is shown in U.S. Pat. No. 2,641,288. In this trimmer, the positioning of the carriage at the selected position is effected manually and, accordingly, is slow and requires the attention and effort of a trimmer attendant.

A general object of the invention is to provide a lumber trimmer in which the positioning of the carriage can be effected rapidly and accurately using a simple and inexpensive power operated positioner In accordance with the present invention there is provided a lumber trimmer of the type having a trim saw carriage which is displaceable lengthwise of the boards by means of a power operated indexer or positioner comprising at least two double-acting fluid pressure cylinders having either their piston rods or their cylinder barrels rigidly connected to one another in series relation. One end of the positioner is connected to a stationary part of the saw table and the opposite end is connected to the trim saw carriage. The lengths of stroke of the two cylinders are dissimilar, the ratio of them being 1:2. By pressurizing one or the other of the two cylinder compartments of each cylinder, the carriage can be positioned in four different, uniformly spaced-apart positions.

In the preferred embodiment, the positioner comprises a third double-acting fluid pressure cylinder connected to one of the two first-mentioned cylinders in series relation and having a length of stroke three times the shortest of the lengths of stroke of the two first-mentioned cylinders. Using this third cylinder, the carriage can be positioned in seven different, uniformly spaced-apart positions.

One exemplary embodiment of a lumber trimmer embodying the principles of the invention will now be described with reference to the accompanying drawing.

Figure 1:
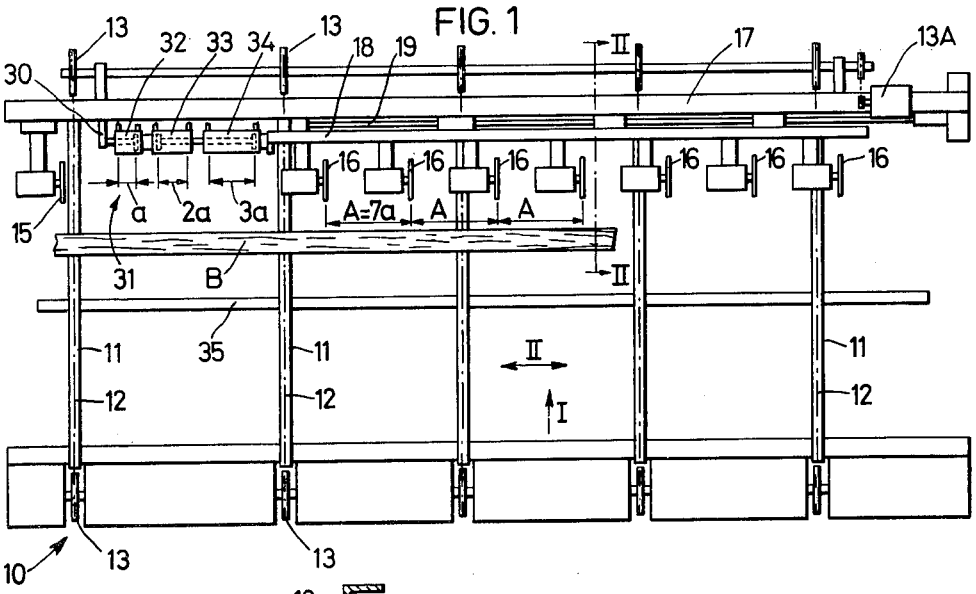
FIG. 1 is a diagrammatic plan view of the trimmer.

The lumber trimmer shown in the drawing comprises a saw table 10 including five parallel rails 11 defining a horizontal bed. The top side of each rail 11 slidably supports the upper run of an endless conveyor chain 12 (indicated by a phantom line in FIG. 1) having driver lugs 12A and running over a pair of sprockets 13. The conveyor chains 12 are driven in unison by a motor 13A to transport boards B or other elongated lumber pieces in a first direction, indicated by an arrow I in FIG. 1 and hereinafter referred to as the transverse direction, across the saw table 10 with the boards or lumber pieces oriented in a second direction, indicated by a double arrow II in FIG. 1 and hereinafter referred to as the lengthwise direction, which is perpendicular to the first direction.

Adjacent the delivery end of the saw table 10 the trimmer has a saw station comprising a single base-end saw 15 and seven trim saws 16. All saws 15 and 16 are circular saws driven by individual electric motors and are spaced-apart along and carried by a horizontal beam 17 which extends in the lengthwise direction and is disposed above the bed defined by the rails 11. The saw blades of all saws are disposed in parallel vertical planes.

The base-end saw 15 is stationary with respect to the beam 17 and is disposed such that its saw blade is always in an operative position in which it extends downwardly through the horizontal plane in which the boards are moved on the saw table 10 by the conveyor chains 12.

The trim saws 16 are carried on the beam 17 by a saw carriage 18 which is displaceable in the lengthwise direction along the beam. To this end, the beam 17 is provided with guide bars 19 on which rollers 20 mounted on the saw carriage are supported. The trim saws 16 are uniformly spaced-apart in the lengthwise direction, the distance between the saw blades of adjacent trim saws being designated A in FIG. 1.

Figure 2:
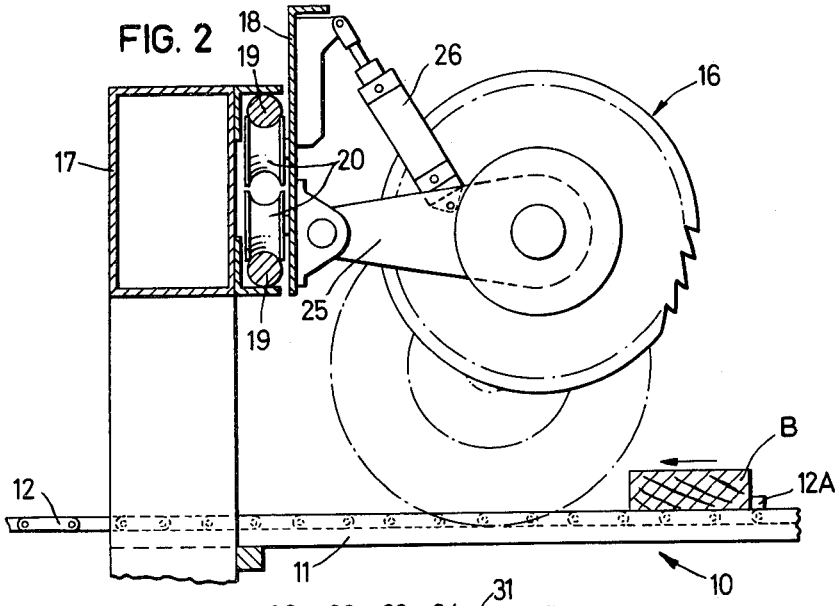
FIG. 2 is a diagrammatic sectional view on the line II—II of FIG. 1.

As best shown in FIG. 2, each trim saw 16 is mounted at one end of a lever 25, the other end of which is mounted for pivotal movement about a horizontal axis on the saw carriage 18. A double-acting pneumatic two-position cylinder 26 is connected between the saw carriage 18 and the lever 25 and normally keeps the trim saw in an inoperative position above the path of movement of the boards, as shown in full lines in FIG. 2. When a board is to be cut by the saw, a control system of the trimmer causes the cylinder 26 to swing the saw downwardly to an operative position as shown in phantom lines in FIG. 2.

A bracket 30 is secured to the beam 17 adjacent the base-end saw 15 and supports one end of a pneumatic linear indexer or positioner 31, the other end of which is connected to the saw carriage 18. This positioner serves to position the saw carriage 18 at any selected one of seven discrete positions uniformly spaced-apart in the lengthwise direction. The distance separating adjacent positions is designated *a* in FIGS. 1 and 3 and is equal to one seventh of the distance A separating adjacent trim saws 16.

The linear positioner 31 comprises three double-acting, that is two-position, pneumatic cylinders 32, 33 and 34, the axes of which are on a common horizontal line in a vertical plane coinciding with or adjacent the vertical plane containing the guide bars 19. The three cylinders are connected with each other in series relation, that is, they are connected with each other in a manner such that extension or retraction of the piston of one of the cylinders will change the position of at least the adjacent one of the other cylinders with respect to the first-mentioned cylinder. The length of stroke of the second or intermediate cylinder 33 is two units of distance, thus 2*a*, and the length of stroke of the third cylinder 34 is three units of distance, thus 3*a*. The unit *a* is 100 mm in the illustrated embodiment but may of course have any suitable value.

As shown in FIG. 1, the barrels of the first and second cylinders 32 and 33 are secured to one another to form a unit, their head ends being adjacent each other and their piston rod ends thus being directed away from each other. The piston rod of the first cylinder 32 is secured to the bracket 30, and the barrel of this cylinder 32 thus can be in either of two discrete positions separated by one unit of distance. The barrel of the third cylinder 34 has its head end connected to the saw carriage 18, and its piston rod end thus is directed toward the second cylinder 33. The adjacent ends of the piston rods of the cylinders 33 and 34 are rigidly secured to one another.

Figure 3:
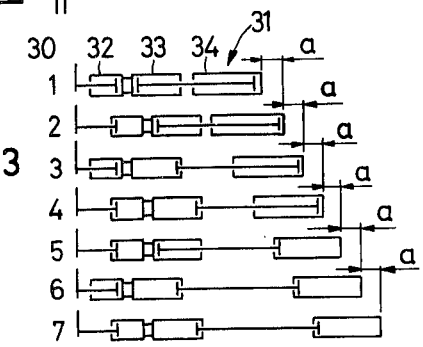
FIG. 3 is a diagram illustrating the seven different lengthwise positions of one end of the linear saw carriage positioner.

By supplying compressed air to either one of the two compartments of each cylinder 32,33,34, the head end of the cylinder 34, and thus the saw carriage 18 with the trim saws 16, can be positioned in any selected one of seven predetermined positions. This is illustrated in FIG. 3, in which the seven successive positions are numbered 1 to 7. As shown in FIG. 3, the adjacent positions are spaced-apart by one unit of distance, *a*. Thus, using the seven trim saws 16 shown in FIG. 1 and spacing the saws by seven units of distance, the total number of cutting positions at which the saw blades of the trim saws may be positioned is fortynine. These positions are uniformly spaced-apart in the lengthwise direction over a distance on the saw table 10 equal to seven times the distance A.

The control of the supply of compressed air to the linear positioner 31 and to the cylinders 26 is effected manually or automatically. Automatic control may be effected by sensors (not shown) mounted on a horizontal bar 35 of the saw table 10 and arranged to detect the lengthwise position of the ends of the boards or other lumber pieces to be trimmed. The trimmer may also include devices (not shown) effective to ensure that the base end of the lumber pieces is alway positioned in an appropriate lengthwise position relative to the base-end saw 15. As soon as a trimmed lumber piece has been discharged from the saw table 10, the information about the required positioning of the saw carriage 18 and the actuation of one of the trim saws 16 is extinguished from the control equipment, which is then ready to receive the corresponding information relating to the next lumber piece to be cut.

What is claimed is:

1. Lumber trimmer, comprising a saw table having a lumber conveyor for moving lumber pieces in a first direction across the saw table with the lumber pieces oriented in a second direction perpendicular to the first direction; a first end cutting device on the saw table, including a cutter for cross-cutting one end of the lumber pieces at a first cutting position; a second end cutting device on the saw table, including a common cutter support displaceable in the second direction and a plurality of cutters selectively operable for cross-cutting the other end of the lumber pieces at a selected one of a plurality of second cutting positions spaced-apart in the second direction, the cutters of the second end cutting device being evenly spaced apart in the second direction on said support; and a power operated linear positioner for selectively positioning the cutter support at discrete positions spaced apart in said second direction, said positioner being connected between a stationary holder on said saw table and said cutter support and including first and second double-acting fluid pressure cylinders connected with one another in additive relation, the length of stroke of one of said cylinders being one unit of distance and the length of stroke of the other cylinder being two units of distance, and the spacing of adjacent cutters on said cutter support being a multiple of said unit of distance.

2. Lumber trimmer according to claim 1 in which the linear positioner includes a third double-acting fluid pressure cylinder connected with the first and second cylinders in additive relation and having a length of stroke equal to three of said units of distance.

3. Lumber trimmer according to claim 2 in which the cutters of the second end cutting device are spaced apart a distance equal to the sum of the lengths of stroke of the first, second and third fluid pressure cylinders plus one unit of distance.

4. Lumber trimmer according to claim 1 in which the cutters of the second end cutting device are spaced apart a distance larger than the sum of the lengths of stroke of the first and second fluid pressure cylinders.

* * * * *